US005160145A

United States Patent [19]

Bokhagen

[11] Patent Number: 5,160,145

[45] Date of Patent: Nov. 3, 1992

[54] APPARATUS AND METHOD OF PLAYING A BOARD GAME

[75] Inventor: Bernt Bokhagen, Stockholm, Sweden

[73] Assignee: Lyckplay AB, Lycksele, Sweden

[21] Appl. No.: 602,256

[22] PCT Filed: Jun. 19, 1989

[86] PCT No.: PCT/SE89/00349

§ 371 Date: Jan. 23, 1991

§ 102(e) Date: Jan. 23, 1991

[87] PCT Pub. No.: WO89/12485

PCT Pub. Date: Dec. 28, 1989

[30] Foreign Application Priority Data

Jun. 20, 1988 [SE] Sweden ..... 8802313

[51] Int. Cl.[5] ..... A63F 3/02

[52] U.S. Cl. ..... 273/260; 273/288; 273/282.3

[58] Field of Search ..... 273/260, 261, 262, 283, 273/282 R, 282 B, 288, 241, 255

[56] References Cited

U.S. PATENT DOCUMENTS

| | | | |
|---|---|---|---|
| 3,627,324 | 12/1971 | Krepp | 273/282 R |
| 3,844,563 | 10/1974 | Isaac | 273/260 |
| 4,211,420 | 7/1980 | Quioz | 273/260 |
| 4,856,789 | 8/1989 | Carlson | 273/261 |
| 4,927,155 | 5/1990 | Bellinger | 273/255 |

FOREIGN PATENT DOCUMENTS

| | | | |
|---|---|---|---|
| 2218646 | 11/1989 | United Kingdom | 273/260 |

*Primary Examiner*—Benjamin Layno
*Attorney, Agent, or Firm*—Michael, Best & Friedrich

[57] ABSTRACT

A board game of the kind which includes a checkered board and a set of game-pieces for each player. The game also includes a home (2) for each player taking part, the home being checkered and having a number of squares which corresponds at least to the maximum number of pieces (8, 9, 10, 11, 12) included in a set and the squares of which have the same format as the squares on the checkered board and form a part of the board (1).

22 Claims, 4 Drawing Sheets

9
17

8

10
16

11
19

12

9
18
17
14

8
16

10
13

11

12
18
17
16

9a

8a 10a
13

11a

12a

APPARATUS AND METHOD OF PLAYING A BOARD GAME

BACKGROUND OF THE INVENTION

The present invention relates to family games, or family board games, of the kind which include a checkered playing area comprising squares marked in alternate colours, e.g. black and white or otherwise marked alternately, such as a checkerboard, chessboard, for instance, or some other contrasting colour combination, and a set of game-pieces for each player.

As the reader may well be aware, chess is an ancient game which can be played by solely two players at one and the same time and which, in order to be truly interesting and stimulating, both to the players and to those watching the game, requires the players to have roughly the same degree of skill. Consequently, chess is not a family game in the true sense and therein lies a weakness in the game of chess which many have tried to overcome, by modifying the game in various ways, so that more than two players can take part at one and the same time.

For instance, the U.S. Pat. No. 4,093,237 describes and illustrates one such modified chess game which allows two, three or four players to play simultaneously and which includes conventional chess pieces, one set for each player. The pieces are set out in their intended places on a checkered board which includes 100 squares and which is thus somewhat larger than a conventional chessboard. The board is divided into four areas of mutually equal size, each consisting of five×five squares. The known variant uses conventional pieces, all of which have the same movement pattern as the pieces of a conventional chess set, with the exception of the pawns, which can be moved forwards, backwards or sideways one square at a time. Because this modified chess game is based on the use of conventional chess pieces, the endeavour to provide a game in which a learner can take part without needing to feel inferior to more experienced players, and to provide a true family game in which all can play without needing any real experience in the game concerned, has not been truly successful. Another drawback with this modified chess game is that it is restricted to a maximum of four players, and this limitation also applies to the majority of board games which have derived from chess.

SUMMARY OF THE INVENTION

Consequently, it is an object of this invention to provide a family game which while being at least equally as rich in combination and variation and therewith at least equally as interesting as chess, can be played in principle by an unlimited number of players, and the construction and nature of which is such as to enable anyone to play the game without particular prior knowledge thereof and yet still experience the same game as being interesting, stimulating and above-all entertaining, even when playing with other players who are more or less skilled players.

This object is achieved with the family game provided by the present invention and having the characteristic features set forth in the accompanying claims.

BRIEF DESCRIPTION OF THE DRAWINGS

The inventive family game will now be described in more detail with reference to the accompanying drawings, in which

FIGS. 2–6 illustrate one embodiment of a set of game pieces,

DETAILED DESCRIPTION OF THE PREFERRED EMBODIMENT

Figure 1:
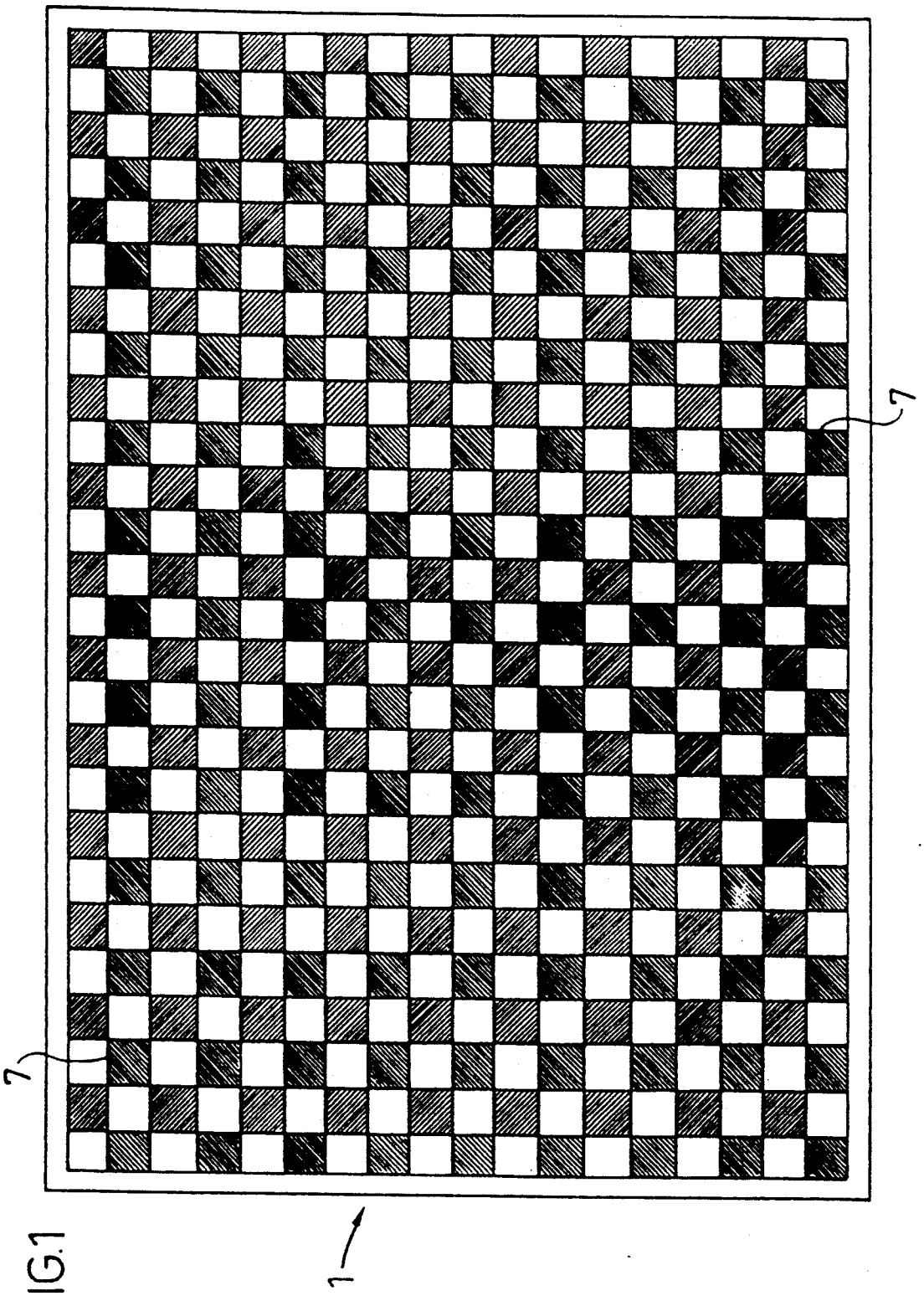
FIG. 1 illustrates a playing board belonging to the game.
Figure 7:
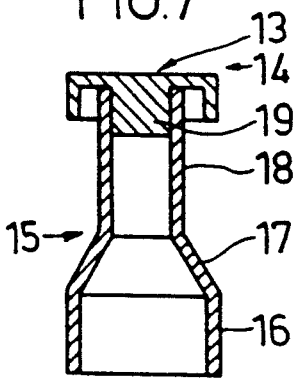
FIGS. 7–9 are sectional views taken on the lines VII—VII in FIG. 2, FIG. 4 and FIG. 6.
Figure 8:
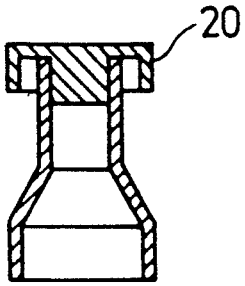
Figure 9:
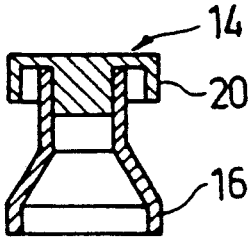
Figure 11:
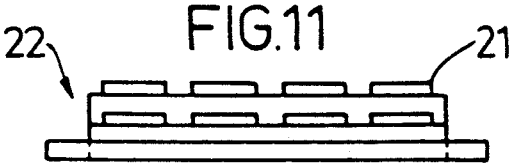
FIG. 11 is an end view of the home illustrated in FIG. 10.
Figure 10:
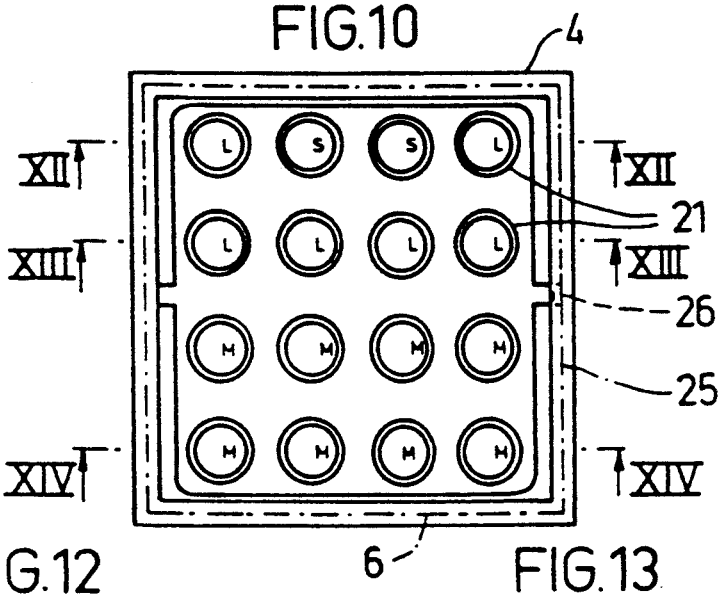
FIG. 10 illustrates from above one embodiment of a home which forms part of the game and which is provided with a transport and storage stand for the game-pieces belonging thereto.
Figure 12:
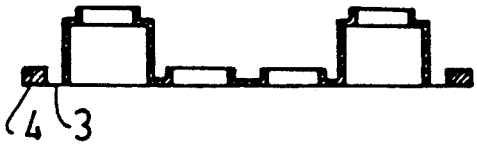
FIGS. 12–14 are each sectional views taken on respective lines XII—XII, XIII—XIII and XIV—XIV in FIG. 10.
Figure 13:
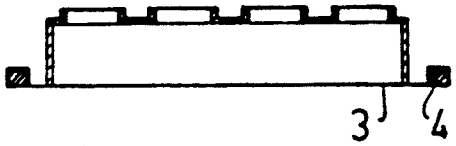
Figure 14:
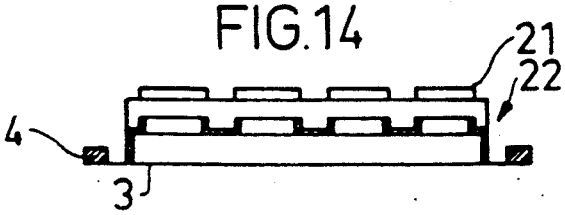
Figure 15:
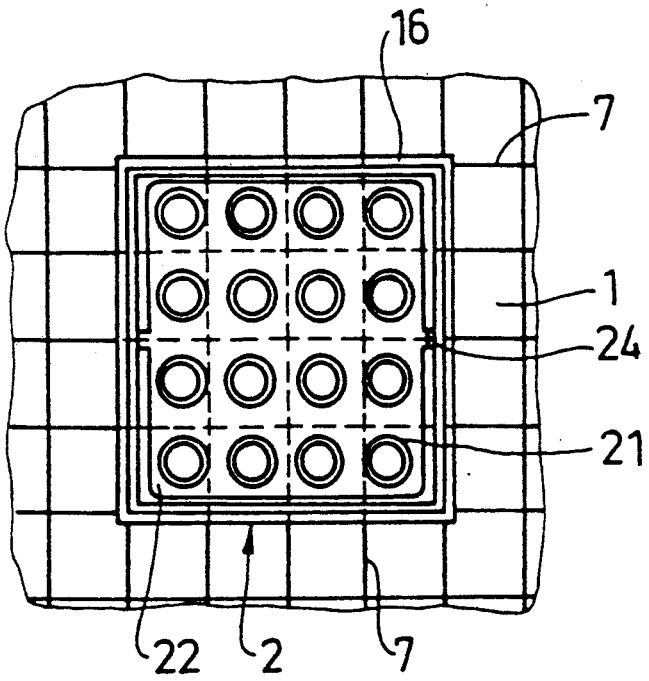
FIG. 15 illustrates part of the board with a home placed thereon.
Figure 16:
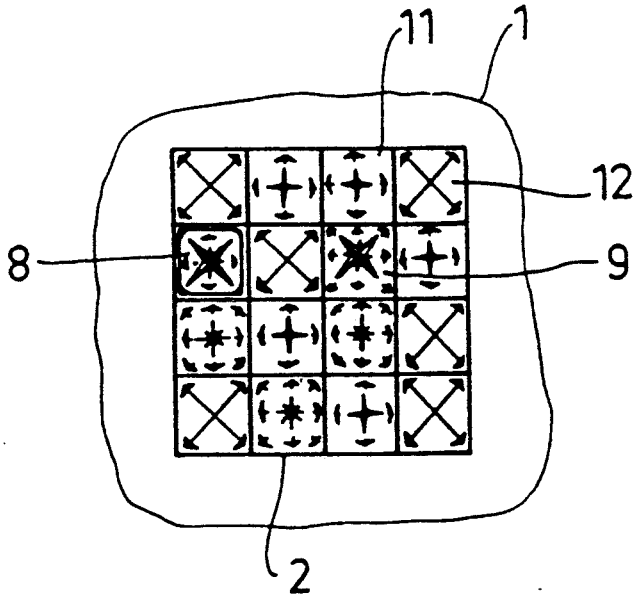
FIG. 16 shows from above a home on which a relevant set of pieces has been placed.

In accordance with the present invention, the inventive family game includes a checkered board 1 whose respective squares are in black and white, or some other contrasting-colour combination. For the purpose of square identification, each square is allocated an individual alpha-numerical reference consisting of a combination of the letters A, B, C . . . etc. and the numerals 1, 2, 3 . . . etc., wherein the letters are placed along the Y-axis of the board, beginning from one corner thereof, and the numerals are placed along the X-axis of said board, beginning from the same corner as the letters, as illustrated in FIG. 1. The illustrated board 1 is dimensioned for a maximum of six players at one and the same time and has 26×18 squares of equal size. In principle, the board can be made as large as desired, by increasing the number of squares in proportion to the number of players, and may be delivered in the form of a game-table, for instance. In addition to the board 1, the inventive game also includes a plurality of homes or operations-bases 2, the number of which equals the maximum number of players for which the game is intended. In the case of the illustrated embodiment each of the homes comprises a square plate 3 which may or may not have surrounding frame 4 (FIG. 10) and which is divided into a number of squares which have the same format as the squares on the board 1, as illustrated in FIG. 15. The surrounding frame 4 of a home-plate 3 will thus encroach on adjacent squares both in the home 2 and on the board 1. This encroachment is of no significance to the game itself and, if considered necessary or expedient, the extent thereof can be restricted significantly, by making the frame members as narrow as possible. In the absence of a surrounding frame 4, each base-plate 3 will have a surface area which corresponds to the surface area of a corresponding number of squares on the board 1, i.e. is the same as the surface area which is delimited by the centre lines 6 of the frame-members, as shown in chain lines in FIGS. 10 and 15, i.e. in the illustrated case an area coresponding to four squares. Thus, when a home-plate 3 is positioned correctly on the board 1, the centre lines 6 of the surround 4 or, in the absence of a surrounding frame, the outer defining edges of respective home-plates will lie on the vertical and horizontal square-defining lines 7 on the board, as also shown in FIG. 15.

Each home of the afore-described kind is separate from the board and is intended to be placed on the board 1 in a position chosen by respective players. Alternatively, the homes 2 may form an integral part of the board 1, in wich case the homes are then marked-out on the board in some appropriate manner, so that respective homes are readily discernible and stand-out clearly on the board. Separate homes which can be placed selectively on the board are to be preferred, however, since this variant enables wide variations to be made within the scope of the rules of the game.

In the case of the illustrated game, each home 2 has four × four squares, i.e. 16 squares, and a corresponding number of pieces is allocated to each home. Thus, in the case of the illustrated embodiment, each home 2 has allocated thereto a maximum of sixteen pieces, and the pieces belonging to each individual home may be allocated a particular colour or some other distinguishing mark, so that the pieces of respective homes can be readily recognized. It is not necessary to arrange the pieces in any particular order in respective homes, and the pieces can be positioned in accordance with the judgement and strategy of the player concerned.

The game-pieces allocated to each home are in five different ranks or categories, each having the respective designation of PRESIDENT, GENERAL, CAPTAIN, LIEUTENANT, and SOLDIER and being referenced 8, 9, 10, 11 and 12 respectively in FIGS. 2–6. In the case of the illustrated embodiment, each piece of the aforesaid rank or category is included in numbers of 1, 1, 3, 5 and 6 in the above order of presentation, although they may also be present in numbers of 1, 1, 4, 5 and 5. In order to enable the various ranks to be distinguished one from the other, the top of each piece is marked with a symbol 8*a*, 9*a*, 10*a*, 11*a* and 12*a* respectively, which identifies the rank possessed by the piece concerned and which also denotes the directions in which said pieces may be moved. These symbols may be let-into or embossed on the top surface 13 of respective pieces, e.g. as by moulding, adhesive bonding or some like method. The pieces of one category or rank can also be made taller or shorter than the pieces of another category or rank, so as to add a further distinguishing feature. In the case of the illustrated embodiment, the game-pieces 8 and 9 have both the same height and are also taller than the pieces 10 and 11, these latter pieces being of mutually the same height but taller than the piece 12. The differences in height between the different ranks is preferably the same, i.e. the height difference between the pieces 10, 11 and 12 is the same as that between the pieces 8, 9 and 10, 11.

Figures 2A, 2B, 2C, 3A, 3B, 3C, 4A, 4B, 4C, 5A, 5B, 5C, 6A, 6B, 6C:
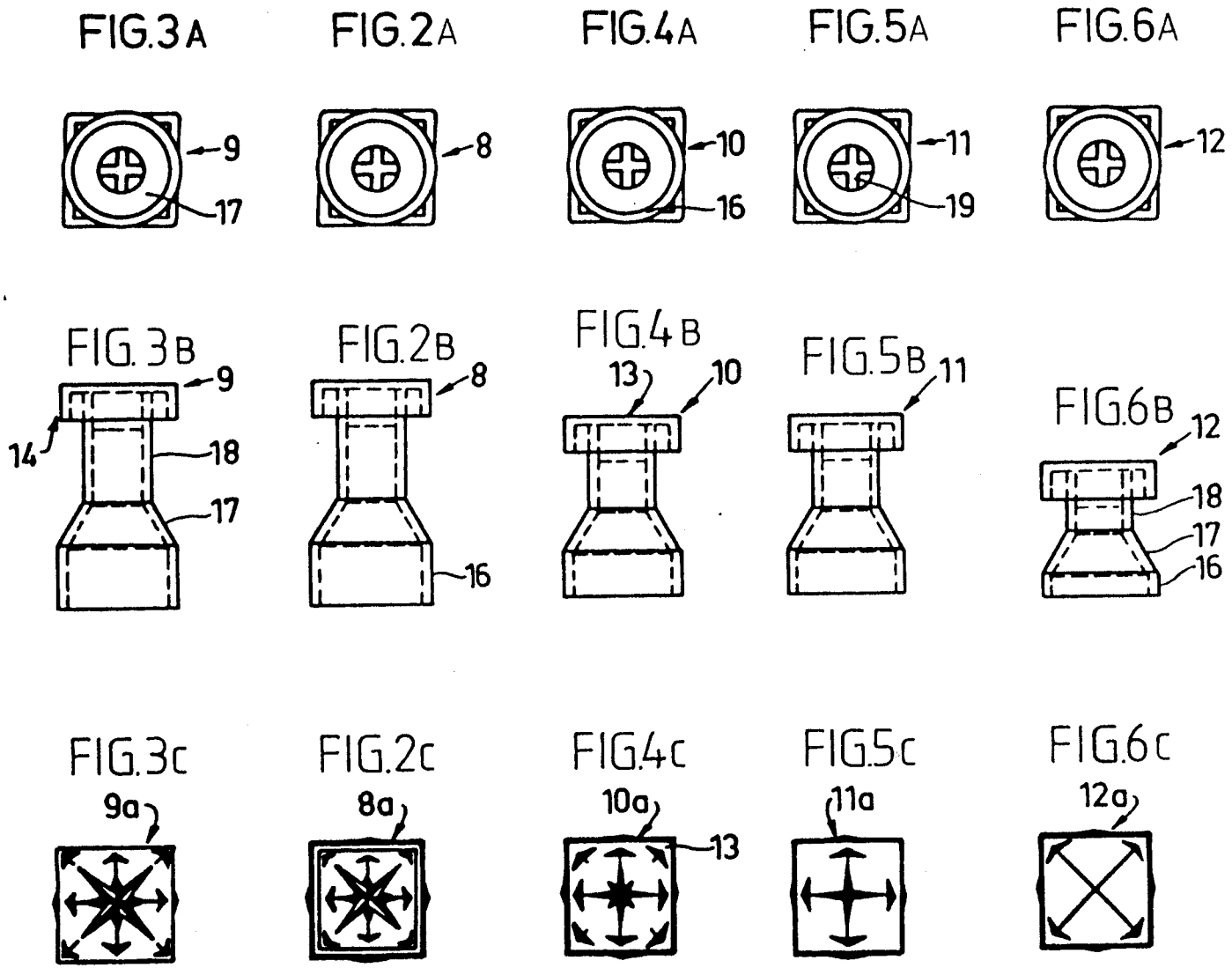
FIGS. 2A, 3A, 4A, 5A and 6A being bottom plan views of respective pieces.
FIGS. 2B, 3B, 4B, 5B and 6B being side elevational views of respective pieces, and FIGS. 2C, 3C, 4C, 5C and 6C being top plan view of respective pieces.

FIG. 2 illustrates the game piece 8, i.e. the PRESIDENT, which constitutes the major piece in each home and which can be moved 1–4 steps in all directions within its own home 2, but which is not allowed to leave the confines thereof. This piece can take, or overcome or capture, all pieces which invade its own home and can itself be taken. The loss of the piece 8 means that the player concerned has lost and must retire from the game.

FIG. 3 illustrates the piece 9, i.e. the GENERAL, which can be moved through any distance and in all directions and which is therefore the most valuable of all the pieces belonging to a home 2. Only one GENERAL and one PRESIDENT are allocated to each home 2. Distinctive from the symbol 9*a* on the piece 9, the arrows of which symbol indicate the unlimited length of movement of said piece in all directions, the essentially similar symbol 8*a* on the piece 8 is bordered by a surround which indicates its limited length of movement in comparison with the piece 9.

FIG. 4 illustrates the piece 10, i.e. the CAPTAIN, of which three are allocated to each home 2 in the case of the illustrated embodiment. Each of these pieces can be moved from 1 to 5 steps in all directions, as is also indicated by the symbol 10*a* of the piece with its arrowed surround. The symbol 10*a* may also be devoid of the heavily pronounced surround which frames the arrows and which coincides with the contour lines of the head of said piece.

FIG. 5 illustrates the piece 11, i.e. the LIEUTENANT, of which five are located to each home 2. Each of these pieces 11 can be moved from 1–5 steps forwards, backwards and sidewards, as indicated by the arrowed surround on the piece-symbol 11*a*. The same applies to the symbol 11*a* as to the symbol 10*a* with regard to the surround framing said arrows.

FIG. 6 illustrates the piece 12, i.e. the SOLDIER, six of which are allocated to each home 2 in the case of the illustrated embodiment. Each of the pieces 12 can be moved from 1 to 5 steps solely in a diagonal direction, as indicated by the arrowed surround of the symbol 12*a* on said piece. With regard to the surround which frames the arrows on the symbol 12*a*, the same applies as that mentioned with respect to the symbols 10*a* and 11*a*.

All of the various pieces are of essentially identical configuration and the dissimilarities between respective ranks or categories lie solely in their mutually different heights. Thus, each piece of the illustrated embodiment has a square head 14 and a hollow body 15, which is preferably formed in one piece. The body 15 includes a hollow-cylindrical base 16, the diameter of which is not greater than, but equal to or smaller than the length of one side of the squares, and further includes a conical waist-part 17 and a cylindrical neck-part 18, the diameter of which is smaller than the diameter of the base 16. The cross-dimension of the square head 14 will preferably be equal to or smaller than, but not larger than the cross-dimension of the squares on the board 1, and may conveniently be equal to the diameter of the base 16, or optionally greater than this diameter when the base diameter is smaller than the cross-dimension of a square. The head 14 is joined to the neck-part 18 of the body 15 with the aid of a peg 19 of cruciform or round configuration which grips in said neck-part 18 and which is secured thereto with the aid of an adhesive or by a press-fit between said two parts, for instance. The head 14 may optionally be formed integrally with the body 15 and instead of a peg may be provided with a centrally located hole in which the neck-part 18 is fitted, either loosely or rigidly. In the illustrated embodiment, the head 14 of each piece has a depending collar 20 which when moving respective pieces during a game affords a better grip than if no collar was provided. The collar 20 can be omitted, however, in which case the piece is gripped around its neck-part 18. As previously mentioned, the symbols of respective pieces are placed in or on the upper surface 13 of the head 14.

The neck-parts 18 of all pieces are of mutually the same length or height and the differences in height between said pieces are found in the neck-part or base thereof. Thus, the neck-part and base of the shortest piece 12, i.e. the SOLDIER, are together shorter than the next piece of higher rank or category by a specific length measurement, this next piece being, in turn, shorter than the next piece of higher rank or category, by a specific length measurement. However, each piece shall have a base 16 with an internal height which at least corresponds to the height of one seat 21 of a plurality of seats 21 located on a game-piece transporting and game-piece storage stand 22 assigned to a home 2, the number of seats provided corresponding to the number of pieces allocated to the home 2.

One such stand 22 is illustrated in FIGS. 10–14. The stand includes seats 21 in numbers corresponding to the number of pieces allocated. The illustrated seats 21 have the form of upstanding, circular collars 23, but may also have the form of cylindrical pegs, which similar to said collars will have an external diameter which corresponds to the internal diameter of the hollow base 16 of a respective game piece, so that the pieces will be held detachably on respective seats 21 by friction.

The seats 21 are arranged in rows on the stand 22, at levels adapted to the height or length of respective pieces (FIGS. 12–14), so that when the pieces are placed on their respective seats 21 on the stand 22, the upper surfaces 13 of said pieces will lie in one and the same plane. In the illustrated case, with 16 game-pieces in each home 2, the stand 22 is configured with 16 seats, 21 disposed in four rows, of which one row (FIG. 12) includes the seats intended for the two tallest pieces 8 and 9 and two seats 21 which are raised to a higher level and which are intended for two of the shortest pieces 12. One row of seats 21 (FIG. 13) is intended for the remaining four pieces 12 and two rows (FIG. 14) are intended for the pieces 10 and 11 of mutually equal height.

The stand 22 is a one-piece structure formed preferably from a plastics material and has at least two outwardly projecting tongues 24 which abut the frame 4 of the home 2 on which it is placed and which function to hold the stand in said home. During transportation of the game, these tongues 24 can be secured to the frame 4. When the home 2 has no frame, the tongues 24 may be U-shaped, so as to engage around respective edge surfaces 25 of the base plate 3, said edge surfaces having formed therein a recess 26 (FIG. 10) corresponding to the width of the tongues, so as to restrain the tongues against sliding along respective surfaces 25. A stand of this configuration will greatly facilitate storage of the game-pieces.

The game is started, with each player seating herself-/himself around the board 1 and being provided with a home 2 and a set of 16 game-pieces. Each player can choose where the various pieces are placed in his/her home 2 and there is thus no requirement for the pieces to be placed in specific positions in the home 2, although if agreed, the piece placings can be divulged, so that each player can place his/her pieces in the same positions as the others. Furthermore, it is not necessary to use all sixteen pieces, and the players themselves can decide the number of pieces 10, 11 and 12 to be included in the game. The pieces 8 and 9, however, should always be included. When the homes 2 are separate from the board 1, no player may place his/her home closer than 4–5 squares from the home of his/her neighbour, in all directions. The first player to position his/her home on the board 1 is decided either by selection between the players themselves or by the possession of a home of specific colour, e.g. red. The players then place their respective homes on the board 1 in turn, starting from the left of the first player, until all homes 2 are in position on the board 1.

Once all homes 2 have been placed in position on the board 1, each player is at liberty to place his/her game-pieces in the home as he or she wishes and according to his or her own strategy. Naturally, it is important to protect the major piece 8 against direct attack from other pieces, since the piece 9, i.e. the GENERAL, can move to any position on the board in a straight line and can therefore eliminate immediately the PRESIDENT in an adjacent home 2, in a single move.

As before mentioned, the game can be played by two, three, four, five or six people simultaneously, although the board 1 can be extended so as to enable more than six players to take part at one and the same time, and therefore there is no actual upper limit to the number of players that can play. Accordingly, each game is accomanied with a board-extension.

The object of the game is to take the major piece 8, i.e. the PRESIDENT, of all the other players, by placing a piece on the same square as that occupied by an opponents PRESIDENT within the home. As before mentioned, the PRESIDENT may not leave the confines of his own home 2.

All players play against each other and the winner is the player who still possesses his or her major piece 8 when all others have lost theirs. Each player can move one piece at a time with each move and when all players have moved one of their pieces, each player can maneouvre his or her pieces in relation to one or more of the opponent's pieces. The players are allowed to cooperate with one another, if considered necessary or expedient, in order to reduce the number of pieces of a player who, for instance, is found to be in a superior position at a given stage of the game. This cooperation between the players can also make a game very interesting and can result in rapid swings in the status of respective players, making it difficult to ascertain who will be the winner at the end of a game.

When a player moves his or her piece onto a square occupied by an opponent's piece, the opponent's piece is eliminated from the game and lifted from the board 1. Each player is entitled either to take an opponent's piece or to refrain from taking said piece, and when a player succeeds in taking the PRESIDENT of an opponent, the player is entitled to take command of all the remaining pieces of the opponent thus eliminated from the game and to use these pieces as his own, against those players remaining in the game. If this player subsequently looses his or her PRESIDENT to another player, this other player then takes command of all of the pieces of the eliminated player and also the pieces previously captured from the earlier eliminated player. Players who have lost their respective PRESIDENTS remove their homes 2 from the actual board, unless of course the home is an integral part of the board and the remaining pieces in the home are placed on the squares beneath the home 2 and are taken into the service of the player who captured the PRESIDENT. All captured pieces are lifted from the board 1, including the PRESIDENTS.

It is not permitted to jump over a piece on the board 1 when moving a piece from one square to another, and only one piece may be moved in each move. The move of a defeated opponent is taken-over by the victor, and the pieces are moved from one square to another in directions permissible for the piece concerned. All game-pieces are allowed to attack anywhere on the board 1. As before mentioned, captured pieces are removed from the board 1 and capture of the major piece 8 means that the player to whom the piece belonged is defeated and can no longer take part in the game. All pieces can capture each other and the major piece 8, or the PRESIDENT, defeats all pieces present within its home 2. The PRESIDENT is not allowed to leave the home.

The present invention is not restricted to the aforedescribed and illustrated embodiment, and modifications can be made within the concept of the invention defined in the following claims.

I claim:

1. A board game comprising a checkered board, a set of game-pieces and a home visible on the board for each player taking part, whereby each home has squares with substantially the same size, shape and arrangement as the board and which in number correspond at least to the maximum number of game-pieces in a set constituting different categories of pieces having varying movement length and movement directions and arranged to be located within belonging home in the initial position for the game, characterized in that the size of the checkered area of the board in relation to the maximum number of players that can take part is such that a corresponding number of homes can be placed on said checkered board area with the smallest number of squares between each home being equal to the number of squares located along one side of each home, and in that each home (2) integrated in the game is formed as a separate part (3) intended to be located in fixed or player-selected positions on the checkered board (1).

2. A game according to claim 1, characterized by stands (22) for supporting the pieces of respective homes (2), the number of stands provided corresponding to the number of homes.

3. A game according to claim 2, characterized in that each game-piece has a base-part (16) which fits on piece-seats (21) provided on the stand (22).

4. A game according to claim 3, characterized in that, in addition to the base-part (16), each piece further includes a head (14), and in that the top surface of the head has provided thereon a symbol which at least indicates the directions in which the piece can be moved.

5. A game according to claim 4, characterized in that each base-part includes a body comprising a waist-part (17) and a neck-part (18) to which the head (14) is connected, either permanently or detachably.

6. A game according to claim 5 characterised in that the seats (21) on the stand (22) have the form an annular collar or a circular peg; and that the base-part (16) is of hollow-cylindrical configuration and has an internal diameter which corresponds to the external diameter of said seats (21).

7. A game according to claim 5, characterised in that the seats (21) on the stand (22) are so positioned that the top surface (13) of respective pieces will lie in one and the same plane, even when the pieces are of mutually different heights.

8. A game according to claim 5, characterized in that the seats (21) on the stand (22) have the form of an annular collar or a circular peg, and that the base-part (16) is of hollow-cylindrical configuration and has an internal diameter which corresponds to the external diameter of said seats (21).

9. A game according to claim 5, characterized in that the seats (21) on the stand (22) are so positioned that the top surfaces (13) of respective pieces will lie in one and the same plane, even when the pieces are of mutually different heights.

10. A game according to claim 4, characterized in that the seats (21) on the stand (22) are so positioned that the top surfaces (13) of respective pieces will lie in one and the same plane, even when the pieces are of mutually different heights.

11. A game according to claim 10, characterised in that the seats (21) on the stand (22) have the form an annular collar or a circular peg; and that the base-part (16) is of hollow-cylindrical configuration and has an internal diameter which corresponds to the external diameter of said seats (21).

12. A game according to claim 11, characterised in that the seats (21) on the stand (22) are so positioned that the top surfaces (13) of respective pieces will lie in one and the same plane, even when the pieces are of mutually different heights.

13. A game according to claim 10 characterised in that the seats (21) on the stand (22) are so positioned that the top surface (13) of respective pieces will lie in one and the same plane, even when the pieces are of mutually different heights.

14. A game according to claim 5 characterised in that the seats (21) on the stand (22) are so positioned that the top surface (13) of respective pieces will lie in one and the same plane, even when the pieces are of mutually different heights.

15. A game according to claim 4, characterized in that the seats (21) on the stand (22) have the form of an annular collar or a circular peg, and that the base-part (16) is of hollow-cylindrical configuration and has an internal diameter which corresponds to the external diameter of said seats (21).

16. A game according to claim 4, characterized in that the seats (21) on the stand (22) have the form of an annular collar or a circular peg, and that the base-part (16) is of hollow-cylindrical configuration and has an internal diameter which corresponds to the external diameter of said seats (21).

17. A game according to claim 16 characterised in that the seats (21) on the stand (22) have the form an annular collar or a circular peg; and that the base-part (16) is of hollow-cylindrical configuration and has an internal diameter which corresponds to the external diameter of said seats (21).

18. A game according to claim 16 characterised in that the seats (21) on the stand (22) are so positioned that the top surface (13) of respective pieces will lie in one and the same plane, even when the pieces are of mutually different heights.

19. A game according to claim 16, characterized in that the seats (21) on the stand (22) are so positioned that the top surfaces (13) of respective pieces will lie in one and the same plane, even when the pieces are of mutually different heights.

20. A board game comprising a checkered board, a set of game-pieces and a home visible on the board for each player taking part, whereby each home has squares with substantially the same size, shape and arrangement as the board and which in number correspond at least to the maximum number of game-pieces in a set constituting different categories of pieces having varying movement length and movement directions and arranged to be located within belonging home in the initial position for the game, characterized in that the size of the checkered area of the board in relation to the maximum number of players that can take part is such that a corresponding number of homes can be placed on said checkered board area with the smallest number of squares between each home being equal to the number of squares located along one side of each home, and characterized by stands (22) for supporting the pieces of respective homes (2), the number of stands provided corresponding to the number of homes.

21. A method for playing board game comprising a checkered board, a set of game-pieces and a home visible on the board for each player taking part, whereby each home has squares with substantially the same size, shape and arrangement as the board and which in number correspond at least to the maximum number of game-pieces in a set constituting different categories of pieces having varying movement length and movement directions and arranged to be located within belonging home in the initial position for the game, characterized in that the size of the checkered area of the board in relation to the maximum number of players that can take part is such that a corresponding number of homes can be placed on said checkered board area with the smallest number of squares between each home being equal to the number of squares located along one side of each home, said method comprising the steps of moving one category of pieces in belonging set of game-pieces (8, 9, 10, 11, 12) only within the belonging home, and moving other categories of pieces in each set of game-pieces (8, 9, 10, 11, 12) on the whole checkered part of the board including all homes.

22. A board game comprising a checkered board, a set of game pieces, and a plurality of home areas visible on the board, the perimeter of each home area being sized and shaped to correspond to a plurality of adjacent square spaces on the board, the number of square spaces within each home area being equal to the number of game pieces in a set, and each home area comprising a stand for supporting the pieces, the number of stands corresponding to the number of home areas.

* * * * *